United States Patent [19]

Gimpera

[11] Patent Number: 4,932,570

[45] Date of Patent: Jun. 12, 1990

[54] ROTARY AND/OR SLIDE VALVE FOR A METALLURGICAL VESSEL

[75] Inventor: José Gimpera, Wiesbaden, Fed. Rep. of Germany

[73] Assignee: Didier-Werke AG, Wiesbaden, Fed. Rep. of Germany

[21] Appl. No.: 326,031

[22] Filed: Mar. 20, 1989

[30] Foreign Application Priority Data

Mar. 18, 1988 [DE] Fed. Rep. of Germany ..... 3809071

[51] Int. Cl.[5] ..... B22D 41/08

[52] U.S. Cl. ..... 222/599; 222/598

[58] Field of Search ..... 222/598, 599, 590; 266/236

[56] References Cited

U.S. PATENT DOCUMENTS 3,651,998 3/1972 Rocher ..... 222/598

FOREIGN PATENT DOCUMENTS 0078760 5/1983 European Pat. Off. .

3540202 11/1986 Fed. Rep. of Germany .

0485821 2/1918 France ..... 222/599

1072995 2/1984 U.S.S.R. ..... 222/599

0183241 7/1922 United Kingdom ..... 222/598

*Primary Examiner*—S. Kastler

*Attorney, Agent, or Firm*—Wenderoth, Lind & Ponack

[57] ABSTRACT

A valve for controlling the discharge of molten metal in a substantially downward direction from a metallurgical vessel has an outer valve part defining an inlet of the valve and an outlet port of the valve, and a refractory inner valve part disposed within the outer valve part in a sealing relationship therewith. The inner valve part has a groove extending therein at the outer peripheral surface which is communicable with the inlet and the outlet port of the outer valve part when the valve is in an open position. The provision of the groove at the outer peripheral surface of the inner valve part does not result in any significant reduction in strength of the inner valve part.

27 Claims, 4 Drawing Sheets

ROTARY AND/OR SLIDE VALVE FOR A METALLURGICAL VESSEL

BACKGROUND OF THE INVENTION

The present invention relates to a rotary and/or slide valve for controlling the discharge of molten metal from a metallurgical vessel, the valve including a fixed refractory outer valve part and a rotary and/or slidable refractory inner valve part disposed within the outer valve part and establishing a seal therewith, wherein the outer valve part defines an inlet of the valve and an outlet of the valve spaced from the inlet, and the inner valve part has a connecting channel and is movable to an open position of the valve at which the connecting channel is open to the inlet and outlet of the valve. The present invention also relates to a refractory outer valve part and to a refractory inner valve part employable in such a valve, and to an assembly in which such a valve is embedded in a portion of the refractory lining of a metallurgical vessel.

One type of such a valve is disclosed in German application P 38 05 071.4. In this valve, the connecting channel of the inner valve part extends radially therethrough. Thus, the connecting channel significantly contributes to a lack of strength of the inner valve part.

Furthermore, it is relatively time-consuming to perform maintenance on the inner valve part such as widening the connecting channel when such becomes clogged or reconstructing the inner valve part by reducing the width of the connecting channel when the same has become widened by the deterioration of the portion of the inner valve part surrounding the connecting channel.

Finally, when the inner valve part is rotated to place the valve in the closed position, both the inlet and the outlet of the valve are closed by the inner valve part. Accordingly, when in such a position, a portion of the molten metal is enclosed in the connecting channel and can harden there causing obvious problems including those requiring the maintenance described above.

Another valve of the aforementioned type is disclosed in DE-PS 35 40 202. This valve is unsuitable for use with an elongated nozzle in a metallurgical vessel. In this valve, a tubular inner valve part extends partially within an outer tubular valve part, and the inlet and outlet of the valve extend radially through the outer valve part while the connecting channel of the inner valve part is defined by a pair of openings extending radially through the inner valve part. A substantially similar type of valve is disclosed in U.S. Pat. No. 3,651,998. As mentioned above, the radial openings contribute to a lack of strength in the respective valve parts.

European Patent Publication No. 0 078 760 discloses a roller-type rotary valve. This valve can only be mounted to the exterior of a metallurgical vessel. This valve also presents a disadvantage in that a significantly large force is required to maintain the two rollers constituting the valve against one another. Furthermore, only a line of contact between the rollers establishes a seal of the valve and, therefore, sealing is suspect in such a valve.

SUMMARY OF THE INVENTION

Accordingly, an object of the present invention is to provide a rotary and/or slide valve for controlling the discharge of molten metal in a substantially downward direction from a metallurgical vessel in which radially extending openings or diametrical through-holes of the inner valve part are obviated thereby overcoming the disadvantage of the prior art regarding the lack of strength of the inner valve part.

More specifically, to overcome such a disadvantage, the present invention provides an inner valve part having a grooved portion including at least one groove that extends in the inner valve part at the outer peripheral surface thereof.

This groove does not reduce the strength of the inner valve part to the degree that the radial opening or diametrical through-hole of the prior art inner valve parts do. Additionally, with respect to the maintenance of the inner valve part of the present invention, the groove can be easily milled or reconstructed after the inner valve part has been removed from the valve since the groove is readily accessible at the outer peripheral surface of the inner valve part.

Another advantage associated with the groove of the present invention extending in the inner valve part at the outer peripheral surface thereof is that, when molten metal is received in the groove during the use of the valve, the molten metal exerts pressure on the inner valve part to effect an improved sealing between the inner and outer valves parts.

Another advantage afforded by the present invention is that, when the valve is in a closed position, or prior to complete closure of the valve, the groove of the inner valve part is open to only one of the inlet and the outlet of the valve. Thus, the molten metal received in the groove is in communication with either the molten metal in the metallurgical vessel or the exterior of the vessel. Accordingly, the molten metal does not have an opportunity to harden in the groove.

BRIEF DESCRIPTION OF THE DRAWINGS

Other objects, features and advantages of the present invention will be apparent from the following detailed description of preferred embodiments thereof, wherein.

DETAILED DESCRIPTION OF THE PREFERRED EMBODIMENTS

Figure 1:
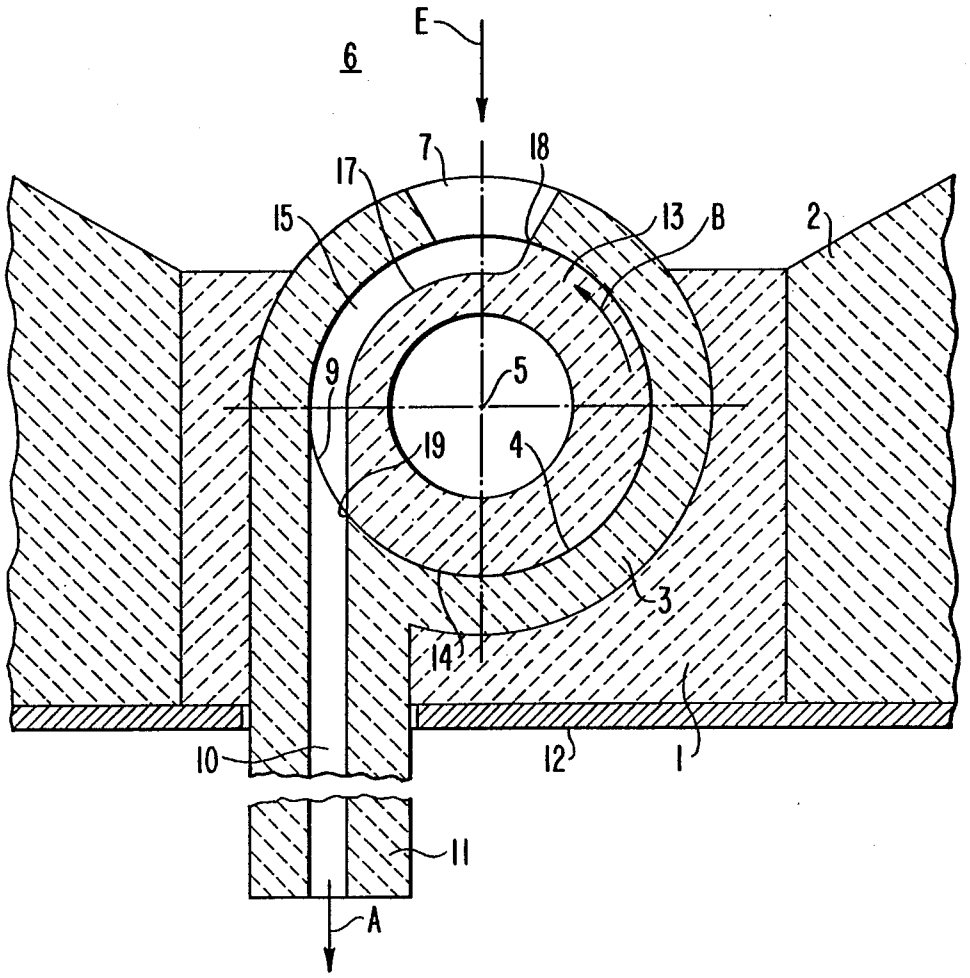
FIG. 1 is a sectional view of a valve for controlling the discharge of molten metal from a metallurgical vessel according to a first embodiment of the present invention, as taken along line I—I of FIG. 2.
Figure 2:
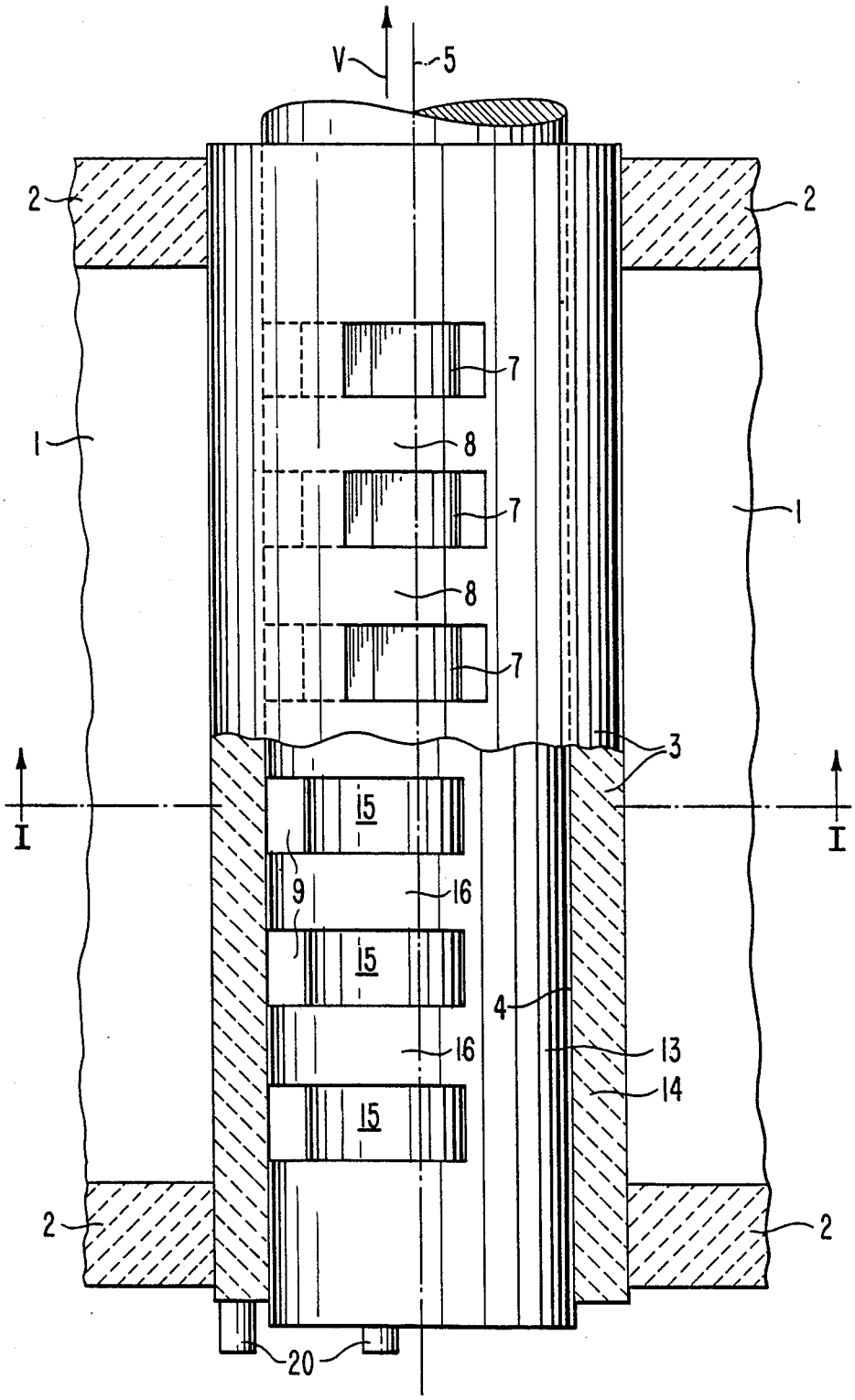
FIG. 2 is a partially broken-away top view of the valve of the present invention embedded in the refractory lining of the bottom wall of a metallurgical vessel.
Figure 3:
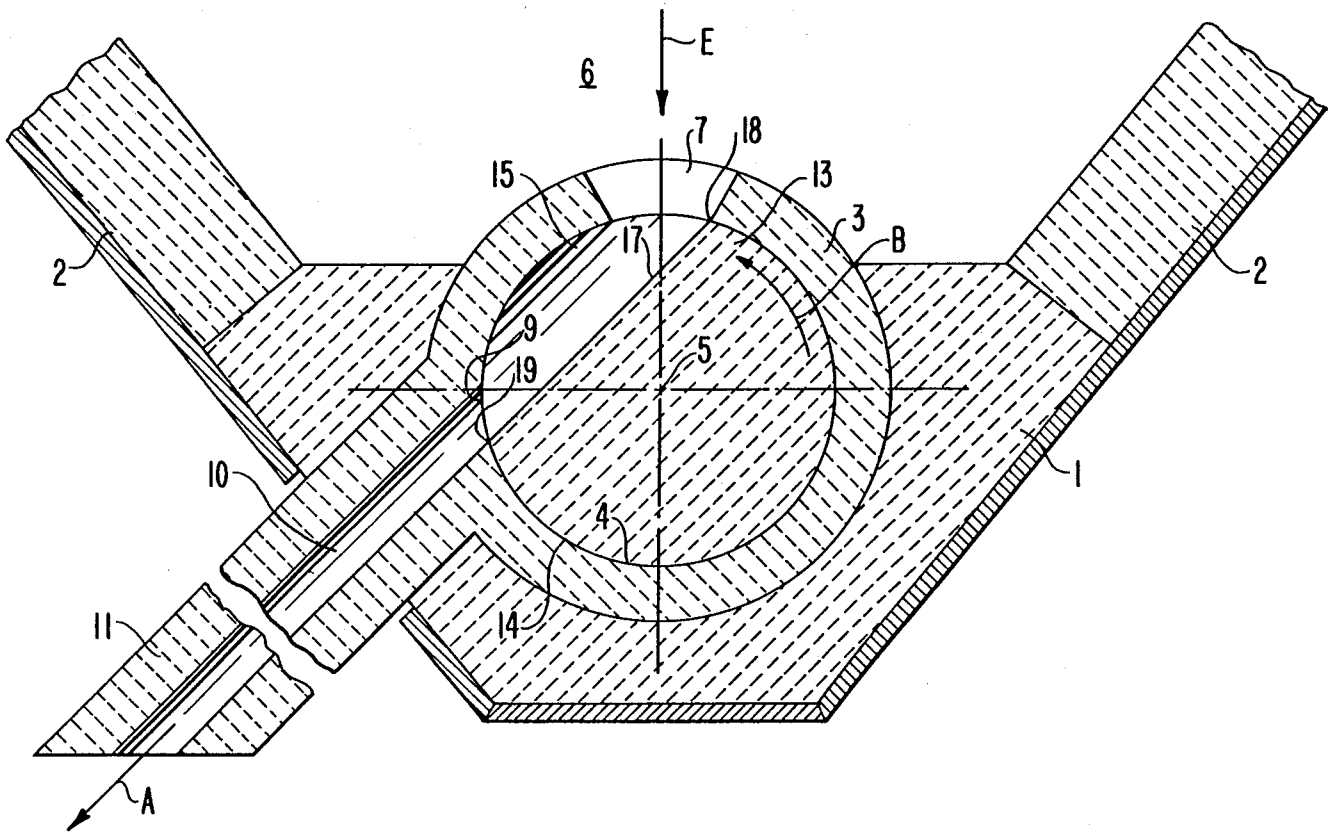
FIG. 3 is a sectional view of a valve for controlling the discharge of molten metal from a metallurgical vessel according to another embodiment of the present invention.
Figure 4:
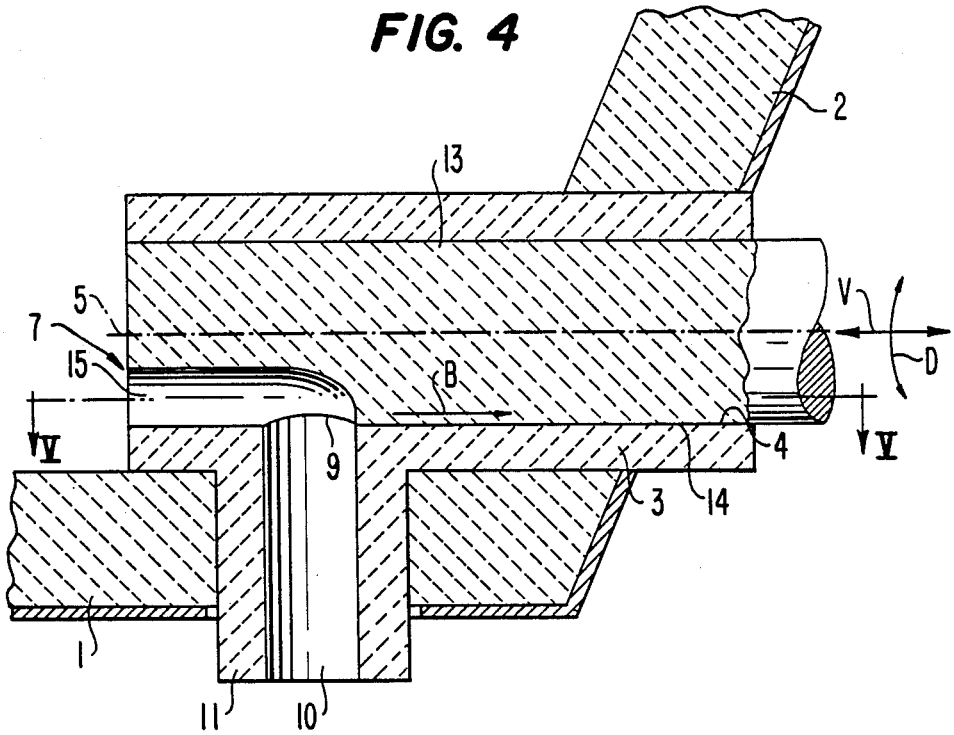
FIG. 4 is a sectional view of a valve for controlling the discharge of molten metal from a metallurgical vessel according to yet another embodiment of the present invention.

Referring now to FIGS. 1, 3 and 4, a metallurgical vessel to which the valve of the present invention finds particular use includes a bottom wall refractory lining 1 and a side wall refractory lining 2. The valve of the present invention can be embedded in the bottom wall refractory lining 1 as shown in FIGS. 1 and 3 or both the bottom wall refractory lining 1 and the side wall refractory lining 2 as shown in FIG. 4. The valve of the present invention comprises a refractory outer valve part 3, preferably ceramic, that is fixable to the refractory lining of the metallurgical vessel so as to be immovable relative thereto. The outer valve part 3 has a cylindrical inner peripheral surface 4 and a longitudinal axis 5. The length of the outer valve part 3 is significantly greater than the diameter thereof. Furthermore, as shown in FIG. 2, the outer valve 3 part can extend the entire length of the metallurgical vessel.

Although the main tubular body of the outer valve part 3 is shown in the drawings as also being cylindrical, the importance of which is to ensure the uniformity of the wall thickness of the tubular body of the outer valve part 3, the outer peripheral surface can nonetheless have any shape that is suitable for facilitating the installation thereof in the lining of the metallurgical vessel. The outer valve part 3 defines an inlet 7 of the valve that is open to the interior 6 of the metallurgical vessel when used therewith. The inlet extends over the length of the outer valve part 3 except at the marginal regions thereof, i.e. the inlet defines a slot extending through the main tubular body of the outer valve part 3. Alternatively, the inlet 7 can also be defined by a plurality of openings with outer valve part webs 8 disposed therebetween as seen in FIG. 2.

The outer valve part also defines an outlet port 9 spaced from the inlet 7. The outer valve part 3 has a recess therein defined by the inner peripheral surface 4 of the outer valve part, the outlet port 9 being open to the recess at the inner peripheral surface 4. The outlet port extends over the length of the outer valve part 3 except at the marginal regions thereof, and is spaced from the inlet 7 circumferentially of the outer valve part by an angle of less than 180° . A nozzle-like integral extension 11 of the outer valve part defines an outlet channel 10 open to the outlet port 9, which outlet channel 10 can have a form of a slot. As shown in FIGS. 1, 3 and 4, the extension 11 projects beyond the bottom plate 12 of the metallurgical vessel but, alternatively, it may terminate thereat. Furthermore, with respect to the extension 11, the extension may be designed to facilitate strip casting. Another particular use for the extension is as an immersion nozzle for a mold placed below the vessel. Finally, the effective width of the inlet 7, i.e. the width of the continuous slot or the sum of the openings defining the inlet, is substantially equal to the effective width of the outlet port 9.

Turning now to the specifics of the embodiment shown in FIG. 1, the direction of flow A of the molten metal through the outlet channel 10 is parallel to the direction of flow E of the molten metal into the inlet 7. Furthermore, the outlet channel 10 extends substantially tangential to the inner peripheral surface 4 of the outer valve part 3. Alternatively, as shown in the embodiment of FIG. 3, the direction of flow A can also define an acute or obtuse angle with the direction of flow E by appropriate design of the extension 11 or outlet channel 10.

A refractory inner valve part 13, also preferably of ceramic, can form a rotor in the valve with the outer valve part 3 acting as a stator, in which case, the inner valve part 13 has an axis of rotation coincident with the longitudinal axis 5 of the outer valve part 3. The inner valve part 13 has a cylindrical outer peripheral surface 14 which establishes a seal with the inner peripheral surface 4 of the outer valve part 3. In FIG. 3, the inner valve part 13 is shown as a solid body. Alternatively, as shown in FIG. 1, the inner valve part can also be hollow so as to have a substantially uniform wall thickness, and in particular, a wall thickness equal to that of the outer valve part 3.

The hollow inner valve part 13 shown in FIG. 1 is particularly useful to facilitate the introduction of gas into the molten metal. To accomplish such, a gas connection is provided on the inner valve part 13 outside of the metallurgical vessel and the inner valve part is provided with gas distribution openings extending therethrough. These openings can be arranged in such a manner as to introduce gas into the molten metal only when the valve is in a closed position.

Furthermore, if the inner valve part 13 is hollow, the interior of the inner valve part can be placed in communication with the molten metal so as to receive molten metal therein. In this manner, the inner valve part 13 may be maintained at the same temperature as the molten metal.

The inner valve part 13 has a grooved portion including at least one groove 15 extending therein at the outer peripheral surface 14. This groove 15 has a length, as taken along the outer peripheral surface 14 of the inner valve part 13 in a given direction B between the inlet 7 and the outlet port 9, that is greater than the distance between the inlet 7 and the outlet port 9 such that the valve may assume an open position as shown in FIGS. 1, 3 and 4 in which the groove 15 is open between the inlet 7 and the outlet port 9. In the embodiment shown in FIGS. 1–3, the groove 15 extends in direction B circumferentially along the inner valve part 13, while in the embodiment of FIG. 4, the groove 15 extends in direction B axially along the inner valve part 13.

As shown in FIG. 1, the groove 15 may have a crescent-shaped cross section as taken in a plane extending radially of the inner valve part 13 while as shown in FIG. 3, the groove 15 may have a segmental cross section as taken in the plane extending radially of the inner valve part. In each of these embodiments, the groove 15 is dimensioned such that the edges defining the terminal ends thereof align with the respective edges of the outer valve part 3 defining the inlet 7 and the outlet port 9 when the valve is in the open position.

Turning now to FIG. 2, the grooved portion of the inner valve part 13 may include a plurality of grooves 15 extending therein with inner valve part webs 16 disposed therebetween. The widths of the inner valve part webs 16 are substantially equal to the widths of the openings defining inlet 7 whereby, when the inner valve part 13 is moved axially in a direction V relative to the outer valve part 3, the inner valve part webs 16 block the openings 7 of the outer valve part 3 whereupon the valve assumes a closed position.

The inner and outer valve parts extend outwardly of the metallurgical vessel as shown in FIGS. 2 and 4. Stops 20 are provided for limiting the rotation of the inner valve part 13 relative to the outer valve part 3. Furthermore, a drive means (not shown) is operatively connected to the inner valve part 13 for moving the inner valve part 13 relative to the outer valve part 3.

The operation of the valve according to the embodiments of the present invention will now be described.

When the valve is in the position shown in FIG. 1, the molten metal flows from the interior 6 of the metallurgical vessel through the inlet 7, into the groove 15, through the outlet port 9 in a direction tangential to the inner peripheral surface 4 of the outer valve part and out of the valve through outlet channel 10 to a succeeding vessel or to a mold. The flowing molten metal in groove 15 exerts pressure on the inner valve part 13 at a surface 17 defining the bottom of the groove whereupon the outer peripheral surface 14 of the inner valve part 13 is forced against the inner peripheral surface 4 of the outer valve part 3 to further enhance the sealing between the peripheral surfaces. If the outlet channel 10 is formed as a slot, thin slabs can be poured directly.

The inner valve part 13 can be moved by the drive means to reduce the effective opening of the inlet 7 so as to control the rate at which molten metal flows through the valve.

The valve can be moved from the position shown in FIGS. 1, 3 or 4 by rotating the inner valve part 13 in a clockwise or counterclockwise direction D until the outer peripheral surface 14 of the inner valve part 13 is disposed over the inlet 7. Reference numerals 17 and 19 designate edges of the outer valve part 3 that are aligned with groove 15 when the valve is in the open position. In the embodiment shown in FIGS. 1 and 3, if the valve is closed by rotating the inner valve part 13 in a counterclockwise direction, the inlet 7 is closed before the outlet port 9 is closed whereby molten metal in groove 15 can continue to flow through the outlet port 9 and into the outlet channel 10. The inner valve part 13 can be rotated past the closed position to a fully closed position at which the outer peripheral surface 14 covers both the inlet 7 and the outlet port 9.

On the other hand, if the inner valve part 13 is rotated in a clockwise direction, the outlet port 9 is closed by the outer peripheral surface 14 of the inner valve part 13. In this case, the molten metal received in the groove 15 remains in communication with the molten metal in the vessel 6 and is therefore prevented from hardening.

Again, the static pressure of the molten metal in the metallurgical vessel acts to enhance the sealing of the inner and outer valve parts at the peripheral surfaces thereof.

In the valve shown in FIG. 2, the inner valve may not only be rotated to move the valve between the open and closed positions thereof, but the drive means may also move the inner valve part 13 axially in the direction of arrow V and in a direction opposite thereto. Thus, in the open position of the valve, the grooves 15 are aligned with the openings defining the inlet 7. In the closed position, as stated above, the inner valve part webs 16 are disposed over the openings defining the inlet 7.

Figure 5:
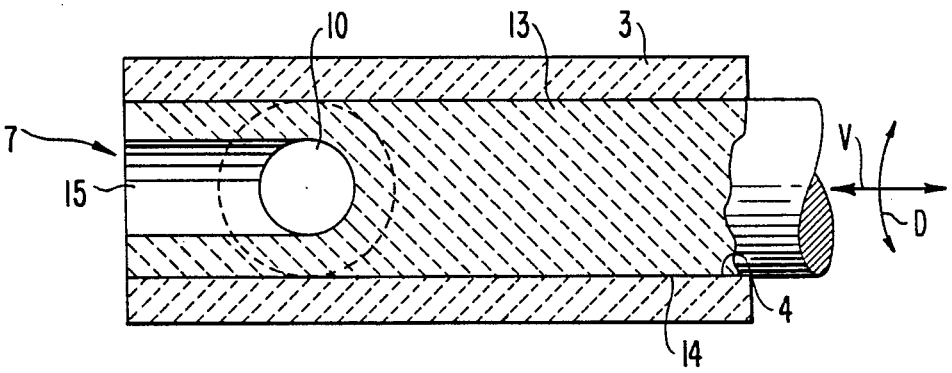
FIG. 5 is a sectional view taken along line V—V of FIG. 4.

While in the embodiments shown in Figs. 1–3, the extension 11 comprises an elongated nozzle, in the embodiment shown in FIGS. 4 and 5, the extension 11 comprises a tubular nozzle. The outlet channel 10 is cylindrical and extends radially to the longitudinal axis 5 of the inner valve part 13. Furthermore, the groove 15 of the inner valve part 13 extends longitudinally along the inner valve part 13 at the outer peripheral surface 14 thereof. In the open position, the molten metal flows horizontally along the bottom of the metallurgical vessel and through the inlet 7 of the valve which is defined by an open end of the tubular main body of the valve. The molten metal enters the groove 15 and is directed through outlet port 9 into the outlet channel 10. To move the valve to the closed position, the inner valve part 13 is driven by drive means so as to rotate in either direction indicated by arrow D until the outer peripheral surface 14 of the inner valve part 13 covers the outlet 9. The molten metal received in the groove 15 remains in communication with the molten metal within the metallurgical vessel thereby preventing the molten metal received in the groove 15 from hardening.

The valve can also be moved to the closed position by moving the inner valve part 13 axially to the left in FIG. 4 as indicated by arrow V until, again, the outer peripheral surface 14 of the inner valve part 13 is disposed over the outlet port 9.

In this embodiment, the valve 13 can be adapted for movement in either or both of the directions indicated by arrows V and D.

Of course, the nozzle shown in the embodiment of FIG. 4 can also be elongated in which case the outlet channel 10 is defined as a slot and the groove 15 extends over a distance corresponding to the length of the slot.

Finally, it is to be noted that the present invention is not limited to a rotary valve. The present invention is also applicable to a slide plate valve in which the inlet and/or outlet of the outer valve part are opened and closed exclusively by sliding the inner valve part. It is self-evident that in this case, the outer peripheral surface of the inner valve part does not have to be symmetrical about a longitudinal axis thereof, i.e. the inner valve part may have a triangular or rectangular cross section.

Although the present invention has been described and illustrated with respect to preferred embodiments thereof, it is to be understood that various modifications and changes may be made to the specifically described and illustrated features without departing from the scope of the present invention.

I claim:

1. A valve for controlling the discharge of molten metal in a substantially downward direction from a metallurgical vessel, said valve comprising:

a unitary refractory outer valve part defining an inlet of the valve, and an outlet port of the valve spaced from said inlet, and said refractory outer valve part having therein a recess defined by an inner peripheral surface thereof, said refractory outer valve part being fixable to a refractory lining of at least one of a side wall and a bottom wall of a metallurgical vessel; and a refractory inner valve part at least partially fitted within said recess and movable relative to said outer valve part, said refractory inner valve part having an outer peripheral surface complementary to and contacting the inner peripheral surface of said refractory outer valve part so as to establish a seal therebetween, the inner peripheral surface of said refractory outer valve part guiding said refractory inner valve part during sliding movement of said inner valve part relative to said outer valve part, said refractory inner valve part having a grooved portion including at least one groove extending in said inner valve part at said outer peripheral surface over a distance, as taken along said outer peripheral surface in a given direction between said inlet and said outlet port, that is greater than the distance at which said outlet port is spaced from said inlet as taken in said given direction and that is less than the entire length of said outer peripheral surface as taken in said given direction, and said refractory inner valve part being movable between an open position of the valve at which said groove is open to and extends between said inlet and said outlet port, and a closed position of the valve at which said inlet and said outlet port are closed to one another by the seal established between the peripheral surfaces of said inner and said outer valve parts.

2. A valve as claimed in claim 1, wherein the peripheral surfaces of said inner and said outer valve parts are cylindrical, and said groove extends circumferentially in said inner valve part such that said inner valve part is rotatable within said outer valve part between said open and said closed positions of the valve.

3. A valve as claimed in claim 2, wherein said inner valve part is also axially slidable within said outer valve part between said open position and a second closed position of the valve at which said inlet and said outlet port are closed by the seal established between the peripheral surfaces of said inner and said outer valve part.

4. A valve as claimed in claim 1, wherein said inner valve part extends axially within said recess, and said groove extends axially in said inner valve part such that said inner valve part is axially slidable within said outer valve part between said open and said closed positions.

5. A valve as claimed in claim 3, wherein the inner peripheral surfaces of said inner and said outer valve parts are cylindrical, and said inner valve part is also rotatable within said outer valve part between said open position and a second closed position of the valve at which said inlet and said outlet port are closed by the seal established between the peripheral surfaces of said inner and said outer valve parts.

6. A valve as claimed in claim 2, wherein said groove extends over an angle of less than 180°.

7. A valve as claimed in claim 3, wherein said groove extends over an angle of less than 180°.

8. A valve as claimed in claim 2, wherein said groove has a generally crescent-shaped cross section as taken in a plane extending radially of said inner valve part.

9. A valve as claimed in claim 6, wherein said groove has a generally crescent-shaped cross section as taken in a plane extending radially of said inner valve part.

10. A valve as claimed in claim 2, wherein said groove has a segmental cross section as taken in a plane extending radially of said inner valve part.

11. A valve as claimed in claim 6, wherein said groove has a segmental cross section as taken in a plane extending radially of said inner valve part.

12. A valve as claimed in claim 1, wherein the effective widths of said inlet, said outlet port and said groove are essentially equal.

13. A valve as claimed in claim 3, wherein the effective widths of said inlet, said outlet port and said groove are essentially equal.

14. A valve as claimed in claim 1, wherein said refractory outer valve part includes a nozzle-like extension having an outlet channel extending therein open to said outlet port.

15. A valve as claimed in claim 14, wherein said nozzle-like extension is a supply means for facilitating strip casting.

16. A valve as claimed in claim 14, wherein said nozzle-like extension is an immersion nozzle.

17. A valve as claimed in claim 1, wherein at least one of said inlet and said outlet port is defined by a plurality of openings extending parallel to one another with outer valve part webs disposed therebetween, and said grooved portion includes a plurality of said grooves with inner valve part webs disposed therebetween.

18. A valve as claimed in claim 3, wherein at least one of said inlet and said outlet port is defined by a plurality of openings extending parallel to one another with outer valve part webs disposed therebetween, and said grooved portion includes a plurality of said grooves with inner valve part webs disposed therebetween.

19. A valve as claimed in claim 17, wherein said inner valve part webs establish said seal with the inner peripheral surface of said outer valve part, and said closed position is one at which said inner valve part webs are disposed over said plurality of openings.

20. A valve as claimed in claim 18, wherein said inner valve part webs establish said seal with the inner peripheral surface of said outer valve part, and said second closed position is one at which said inner valve part webs are disposed over said plurality of openings.

21. A valve as claimed in claim 1, wherein one of said inlet and said outlet port is open to said groove when the valve is in the closed position.

22. A valve as claimed in claim 1, wherein the peripheral surfaces of said inner and said outer valve parts are cylindrical.

23. A valve as claimed in claim 1, wherein said outer valve part defines an outlet channel open to said outlet port, said outlet channel extending generally tangential to said inner peripheral surface.

24. A valve as claimed in claim 1, wherein said refractory outer valve part comprises a main tubular body, said inlet is defined by an open end of said tubular body and said outlet port extends radially through said tubular body.

25. An assembly for controlling the discharge of molten metal in a substantially downward direction from a metallurgical vessel, said assembly comprising:

a valve including a refractory outer valve part defining an inlet of the valve, and an outlet port of the valve spaced from said inlet, and said refractory outer valve part having therein a recess defined by an inner peripheral surface;

a refractory inner valve part at least partially fitted within said recess and movable relative to said outer valve part, said refractory inner valve part having an outer peripheral surface complementary to and contacting the inner peripheral surface of said refractory outer valve part so as to establish a seal therebetween, the inner peripheral surface of said refractory outer valve part guiding said refractory inner valve part during sliding movement of said inner valve part relative to said outer valve part, said refractory inner valve part having a grooved portion including at least one groove extending in said inner valve part at said outer peripheral surface over a distance, as taken along said outer peripheral surface in a given direction between said inlet and said outlet port, that is greater than the distance at which said outlet port is spaced from said inlet as taken in said given direction and that is less than the entire length of said outer peripheral surface as taken in said given direction, said refractory inner valve part being movable between an open position of the valve at which said groove is open to and extends between said inlet and said outlet port, and a closed position of the valve at which said inlet and said outlet port are closed to one another by the seal established between the peripheral surfaces of said inner and said outer valve parts; and a portion of a refractory lining of the metallurgical vessel, said valve embedded in said portion with said outer valve part fixed thereto.

26. An assembly as claimed in claim 25, wherein said portion is to form a bottom wall of the refractory lining.

27. An assembly as claimed in claim 25, wherein said portion is to form a bottom wall and a side wall of the refractory lining.

* * * * *